US010994813B1

(12) United States Patent
Street et al.

(10) Patent No.: US 10,994,813 B1
(45) Date of Patent: May 4, 2021

(54) SIDEWALL SUSPENDED BOAT COOLER

(71) Applicants: Dan Street, Brooksville, FL (US); Danny Street, Brooksville, FL (US)

(72) Inventors: Dan Street, Brooksville, FL (US); Danny Street, Brooksville, FL (US)

( * ) Notice: Subject to any disclaimer, the term of this patent is extended or adjusted under 35 U.S.C. 154(b) by 15 days.

(21) Appl. No.: 16/595,686

(22) Filed: Oct. 8, 2019

Related U.S. Application Data

(63) Continuation-in-part of application No. 16/174,357, filed on Oct. 30, 2018, now Pat. No. 10,717,499.

(51) Int. Cl.
*B63B 25/00* (2006.01)
*B65D 25/22* (2006.01)
*B65D 81/38* (2006.01)

(52) U.S. Cl.
CPC ..... *B63B 25/004* (2013.01); *B65D 25/22* (2013.01); *B65D 81/3813* (2013.01)

(58) Field of Classification Search
CPC . B63B 2017/0054; B63B 25/004; B60N 3/10; B60N 3/103; F25D 23/10; B65D 25/22; B65D 81/3813; B62B 3/00
See application file for complete search history.

(56) References Cited

U.S. PATENT DOCUMENTS 3,775,895 A * 12/1973 Jachim ..... A01K 97/06 43/54.1
4,146,279 A 3/1979 Stahel
D267,444 S * 1/1983 Ruxton ..... D12/419
D273,056 S 3/1984 Lennon
4,593,642 A * 6/1986 Shay ..... B63B 34/20 114/347
5,050,526 A * 9/1991 Nelson ..... A01K 63/02 114/364
5,112,094 A * 5/1992 Kribs ..... B60N 2/75 296/37.8
5,165,198 A 11/1992 Kilian, III
5,492,068 A * 2/1996 McKee ..... B60N 2/793 108/44
6,035,800 A 3/2000 Clifford
6,367,403 B1 4/2002 Carter
(Continued)

FOREIGN PATENT DOCUMENTS

WO 2016210377 12/2016

*Primary Examiner* — Brian D Nash

(57) ABSTRACT

This non-provisional application is a continuation-in-part application filed under 37 CFR 1.53(b) that claims the benefit of United States 35 USC 120 from non-provisional application U.S. Ser. No. 16/174,357 filed on Oct. 30, 2018, by the inventor: Danny Street. The sidewall-suspended boat cooler replaces the U-shaped space of the prior disclosure with a telescopic hook. Specifically, the rear wall overhang extension is removed and replaced by the telescopic hook. The telescopic hook catches on the sidewall of the vessel such that the telescopic hook combines with both: a) the superior horizontal surface of the prior disclosure; and, b) the vertical transfer surface of the prior disclosure to form a mechanical U-shaped structure in which the sidewall of the vessel inserts. The form factor of the telescopic structure is adjustable such that the mechanical U-shaped structure can adjust to accommodate variations in the form factor of the sidewall of the vessel.

14 Claims, 5 Drawing Sheets

(56) References Cited

U.S. PATENT DOCUMENTS

| | | | | |
|---|---|---|---|---|
| 7,029,048 | B1 * | 4/2006 | Hicks | B60N 3/101<br>296/193.04 |
| 7,293,518 | B1 * | 11/2007 | Gassew | A01K 97/10<br>114/219 |
| 8,371,548 | B1 | 2/2013 | Bishop | |
| D703,007 | S | 4/2014 | McCarthy | |
| 9,150,353 | B2 | 10/2015 | Jackson | |
| 10,173,609 | B1 * | 1/2019 | Grimes | B62D 33/033 |
| 2001/0030436 | A1 * | 10/2001 | Kifer | B60R 7/04<br>296/24.34 |
| 2005/0035618 | A1 * | 2/2005 | Toth | B60N 3/101<br>296/24.34 |
| 2005/0248169 | A1 * | 11/2005 | Clark | B60N 2/793<br>296/24.34 |
| 2006/0231716 | A1 * | 10/2006 | Liu | B60R 7/04<br>248/311.2 |

* cited by examiner

SIDEWALL SUSPENDED BOAT COOLER

CROSS REFERENCES TO RELATED APPLICATIONS

This non-provisional application is a continuation-in-part application filed under 37 CFR 1.53(b) that claims the benefit of United States 35 USC 120 from non-provisional application U.S. Ser. No. 16/174,357 filed on Oct. 30, 2018, by the inventor: Danny Street. This non-provisional application incorporates non-provisional application U.S. Ser. No. 16/174,357 in its entirety.

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of food and beverage coolers and boating equipment, more specifically, a sidewall-suspended boat cooler.

This non-provisional application is a continuation-in-part application filed under 37 CFR 1.53(b) that claims the benefit of United States 35 USC 120 from non-provisional application U.S. Ser. No. 16/174,357 filed on Oct. 30, 2018, by the inventor: Danny Street. This non-provisional application incorporates non-provisional application U.S. Ser. No. 16/174,357 in its entirety.

The present disclosure will only reference the elements of the non-provisional application U.S. Ser. No. 16/174,357 that are relevant to the innovations disclosed within this application. This is done for purposes of simplicity and clarity of exposition. The applicant notes that this disclosure incorporates non-provisional application U.S. Ser. No. 16/174,357 in its entirety into this application. The fact that any specific innovation selected from the one or more innovations disclosed within U.S. Ser. No. 16/174,357 is not addressed in this application should not be interpreted as an indication of defect in the above-referenced patent.

Within this disclosure, the non-provisional application U.S. Ser. No. 16/174,357 will also be referred to as the prior disclosure.

A summary of the disclosures contained within the prior disclosure that are relevant to the present disclosure is provided below. This summary is provided for clarity and convenience and is not intended to fully represent or reflect the disclosures contained within the prior disclosure. If a discrepancy occurs between this summary and the prior disclosure, the prior disclosure should be considered correct and this summary should be considered in error.

The prior disclosure discloses an insulating structure used to store one or more foodstuffs. The insulating structure comprises a container 200, a lid 230, and a hinge 245. The hinge 245 attaches the lid 230 to the container 200 such that the lid 230 rotates relative to the container 200. The container is a hollow pan shaped structure used to store the one or more foodstuffs. The lid 230 encloses the container 200 such that the lid 230 and the container 200 combine to form an enclosed storage space. The lid 230 controls access into the container 200 by rotating between an open position and a closed position.

The primary shape of the pan-shaped structure of the container 200 is a rectangular block prism structure. The container 200 comprises a front wall 210, a rear wall 212, a left wall 216, a right wall 218, a bottom and the open face characteristic of a pan structure. The front wall 210, the rear wall 212, the left wall 216, and the right wall 218 are vertically oriented surfaces that form the vertical containment structures of the container 200. The bottom is a horizontally oriented structure that forms the inferior horizontal containment container 200.

The bottom further comprises an inferior horizontal surface 222, a superior horizontal surface 224 and a vertical transition surface 226. The superior horizontal surface 224 forms an undercut ledge that has an elevated position relative to the inferior horizontal surface 222. The vertical transition surface 226 is vertically oriented parapet that joins the superior horizontal surface 224 and the inferior horizontal surface 222.

The rear wall 212 further comprises rear wall 212 overhang extension 295. The rear wall 212 overhang extension 295 is a disk-shaped structure that extends the exterior surface of the rear wall 212 beyond the plane formed by the superior horizontal surface 224. The rear wall 212 overhang extension 295 extends the rear wall 212 in the inferior direction.

The container 200 further forms a U-shaped space. The U-shaped space is a prism-shaped negative space that is formed in the rectangular block prism structure that forms the primary shape of the container 200. The U-shaped space forms a C-channel. The forms a channel through the rectangular block prism structure that forms the primary shape of the container 200 from the left wall 216 to the right wall 218. The U-shaped space is bounded by the following exterior surfaces of the container 200: a) the rear wall 212 overhang extension 295; b) the superior horizontal surface 224; and, c) the vertical transition surface 226.

The U-shaped structure is sized such that the sidewall 905 of a vessel 900 can fit into the U-shaped space. By sidewall 905 is meant a structure selected from the group consisting of the gunwale of the vessel 900 and the transom of the vessel 900. The form factor of the U-shaped structure is selected such that the container 200 is suspended from the sidewall 905.

A limitation of the prior disclosure described above is that the size of the U-shaped structure is fixed. By having a fixed shape, the U-shaped structure cannot be adjusted to accommodate variations in the size the sidewalls either: a) within a first vessel 900; or, b) between a first vessel 900 and a second vessel 900. Clearly, a method to adjust the form factor of the U shaped structure would be of benefit to users an instantiation of the prior disclosure.

SUMMARY OF INVENTION

This disclosure of the sidewall-suspended boat cooler addresses the limitations of the prior disclosure described above.

The sidewall-suspended boat cooler replaces the U-shaped space of the prior disclosure with a telescopic hook. Specifically, the rear wall overhang extension is removed and replaced by the telescopic hook. The telescopic hook catches on the sidewall of the vessel such that the telescopic hook combines with both: a) the superior horizontal surface of the prior disclosure; and, b) the vertical transfer surface of the prior disclosure to form a mechanical U-shaped structure in which the sidewall of the vessel inserts. The form factor of the telescopic structure is adjustable such that the mechanical U-shaped structure can adjust to accommodate variations in the form factor of the sidewall of the vessel.

These together with additional objects, features and advantages of the sidewall-suspended boat cooler will be readily apparent to those of ordinary skill in the art upon reading the following detailed description of the presently preferred, but nonetheless illustrative, embodiments when taken in conjunction with the accompanying drawings.

In this respect, before explaining the current embodiments of the sidewall-suspended boat cooler in detail, it is to be understood that the sidewall-suspended boat cooler is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the sidewall-suspended boat cooler.

It is therefore important that the claims be regarded as including such equivalent construction insofar as they do not depart from the spirit and scope of the sidewall-suspended boat cooler. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
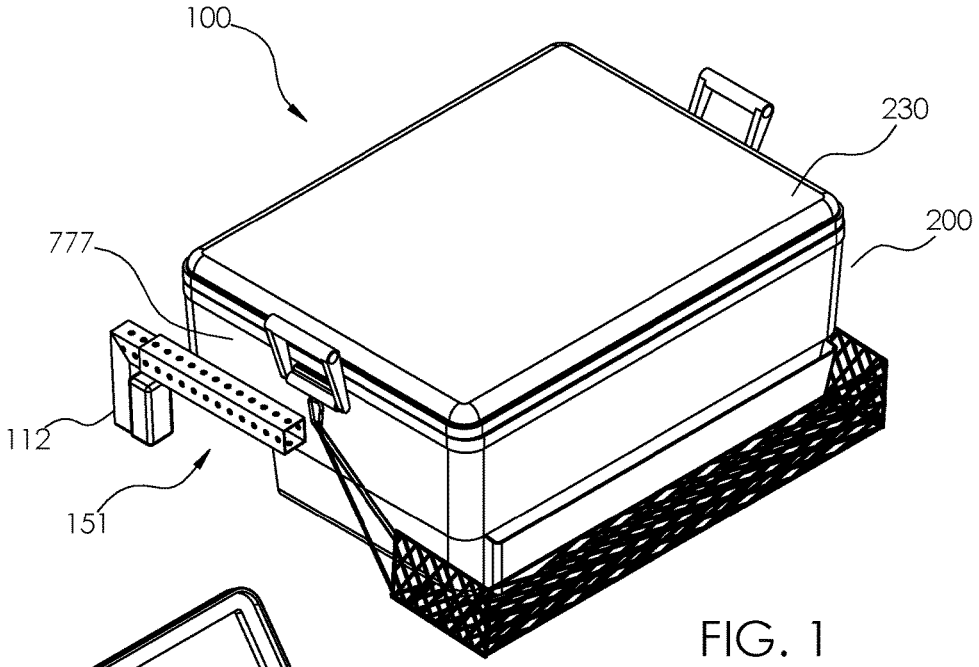
FIG. 1 is a closed perspective view of an embodiment of the disclosure.
Figure 2:
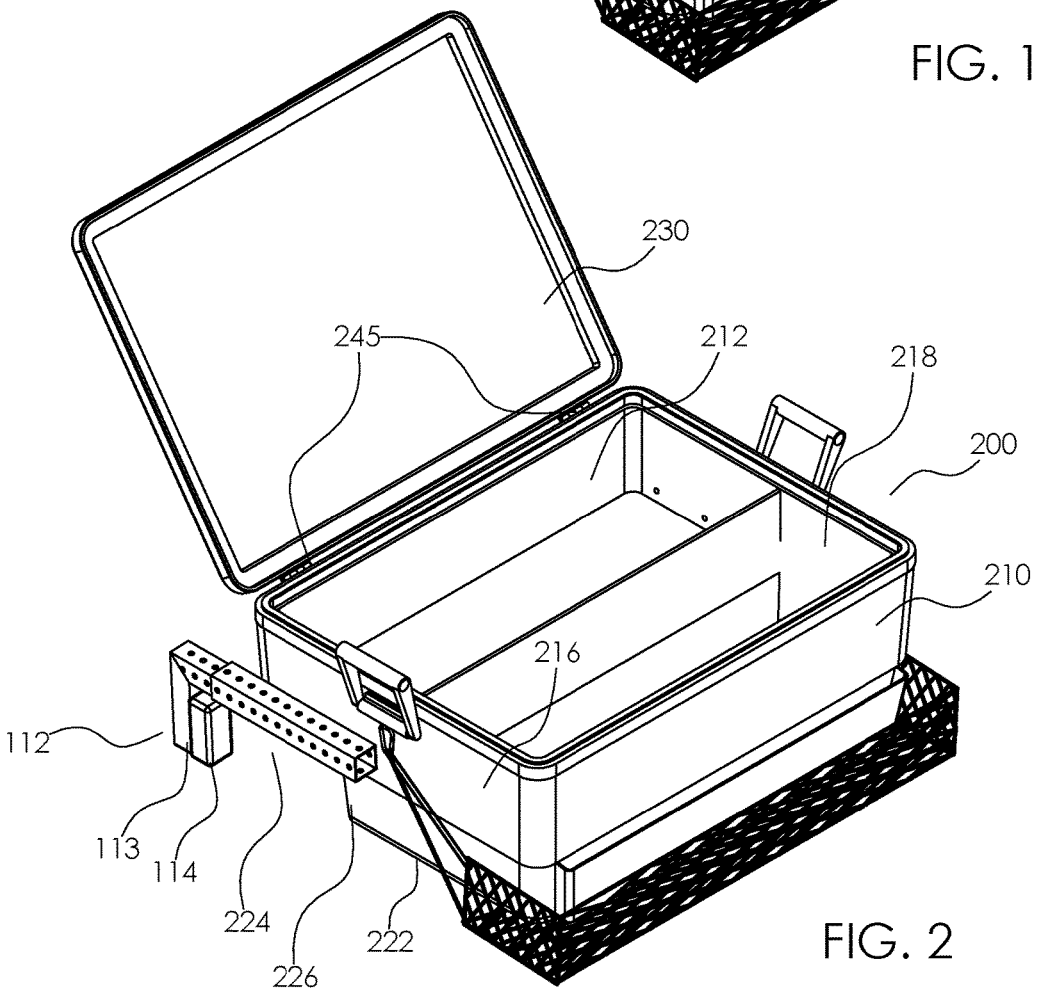
FIG. 2 is an open perspective view of an embodiment of the disclosure.
Figure 3:
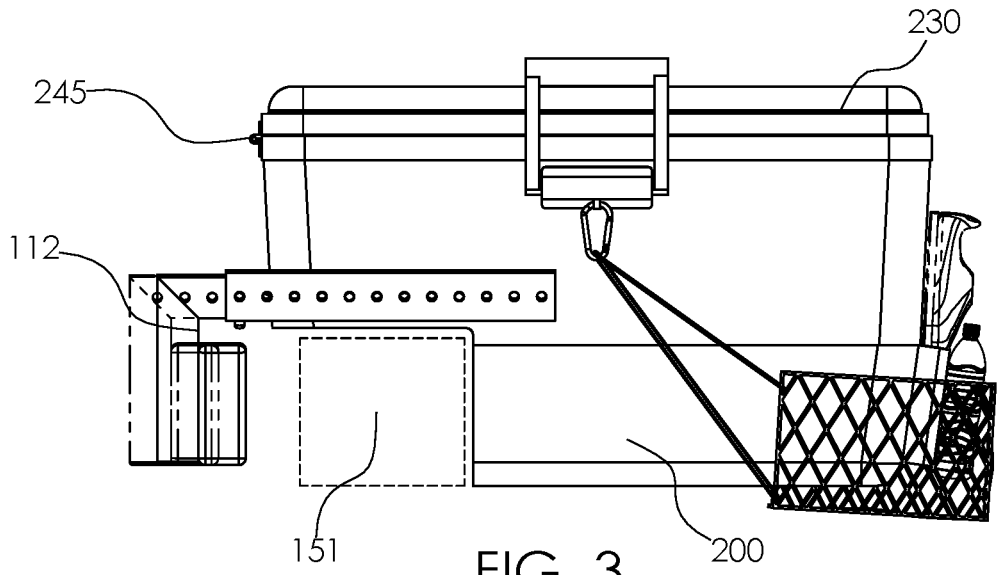
FIG. 3 is a closed side view of an embodiment of the disclosure.
Figure 4:
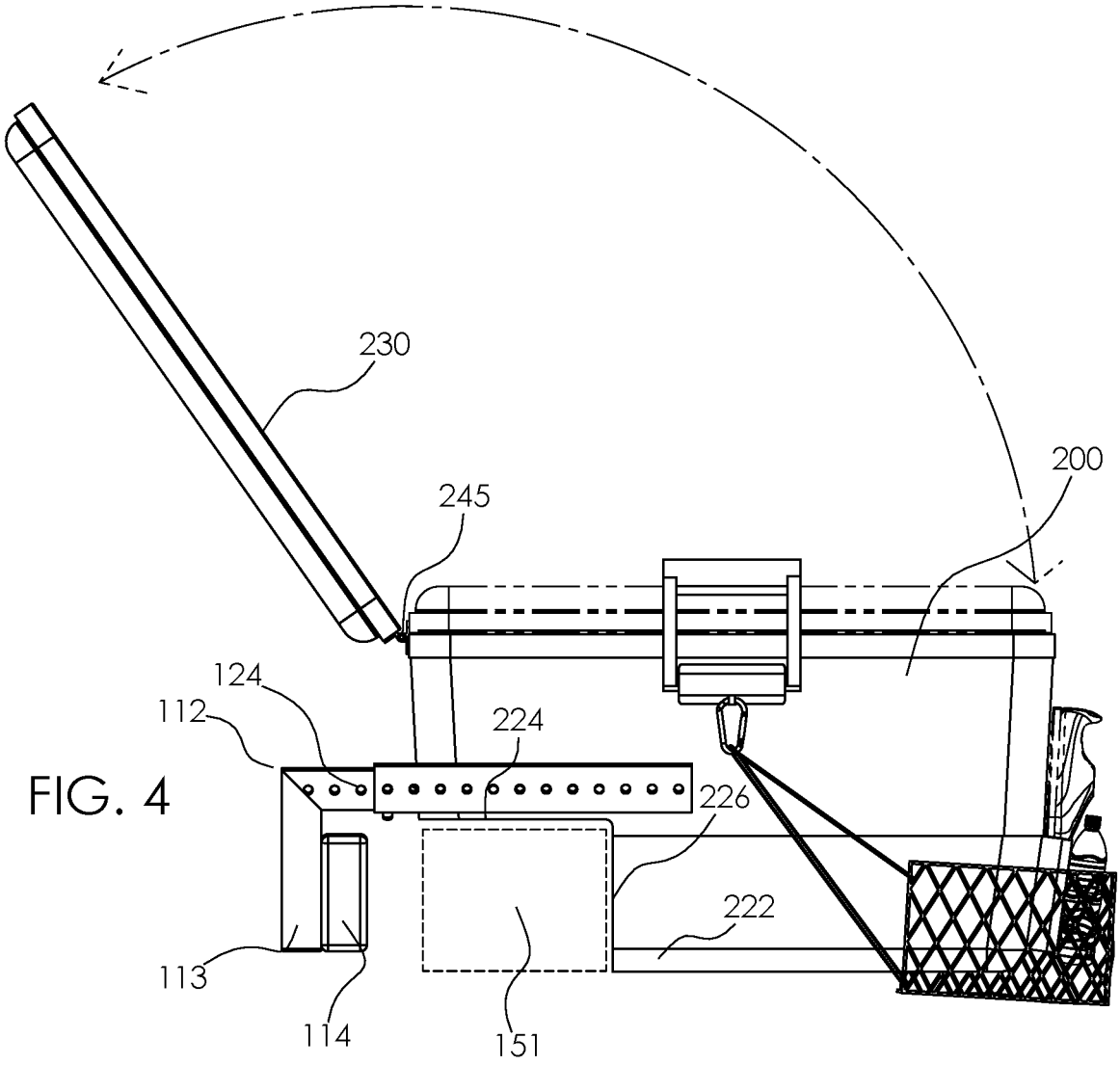
FIG. 4 is an open side view of an embodiment of the disclosure.
Figure 5:
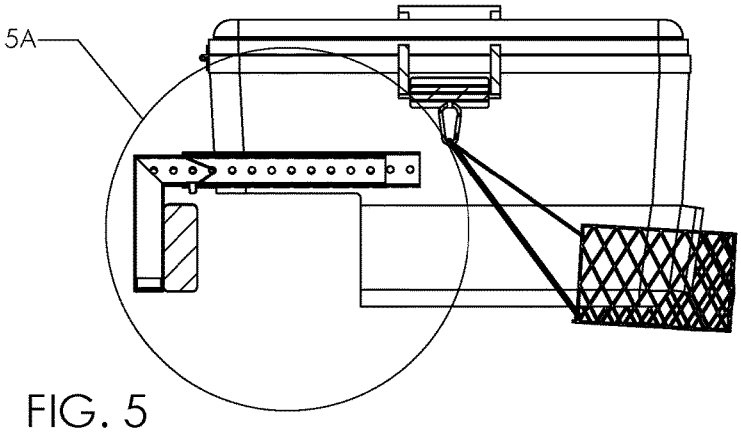
FIG. 5 is a cross-sectional view of an embodiment of the disclosure.
Figure 5A:
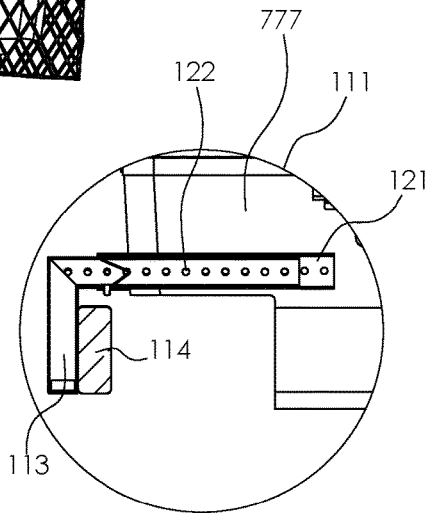
FIG. 5*a* is a detail view of an embodiment of the disclosure.
Figure 6:
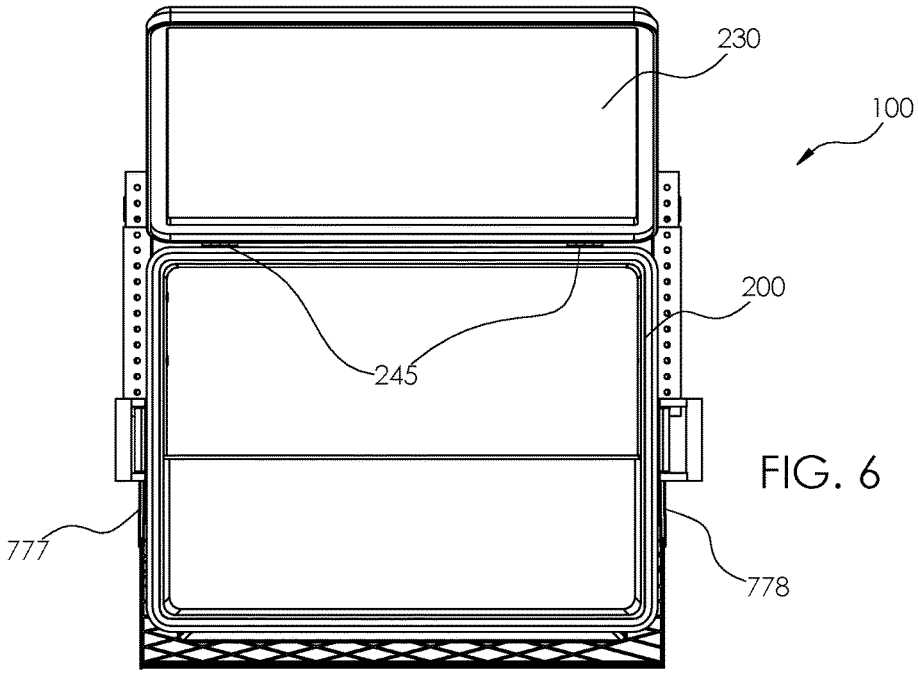
FIG. 6 is a top view of an embodiment of the disclosure.
Figure 7:
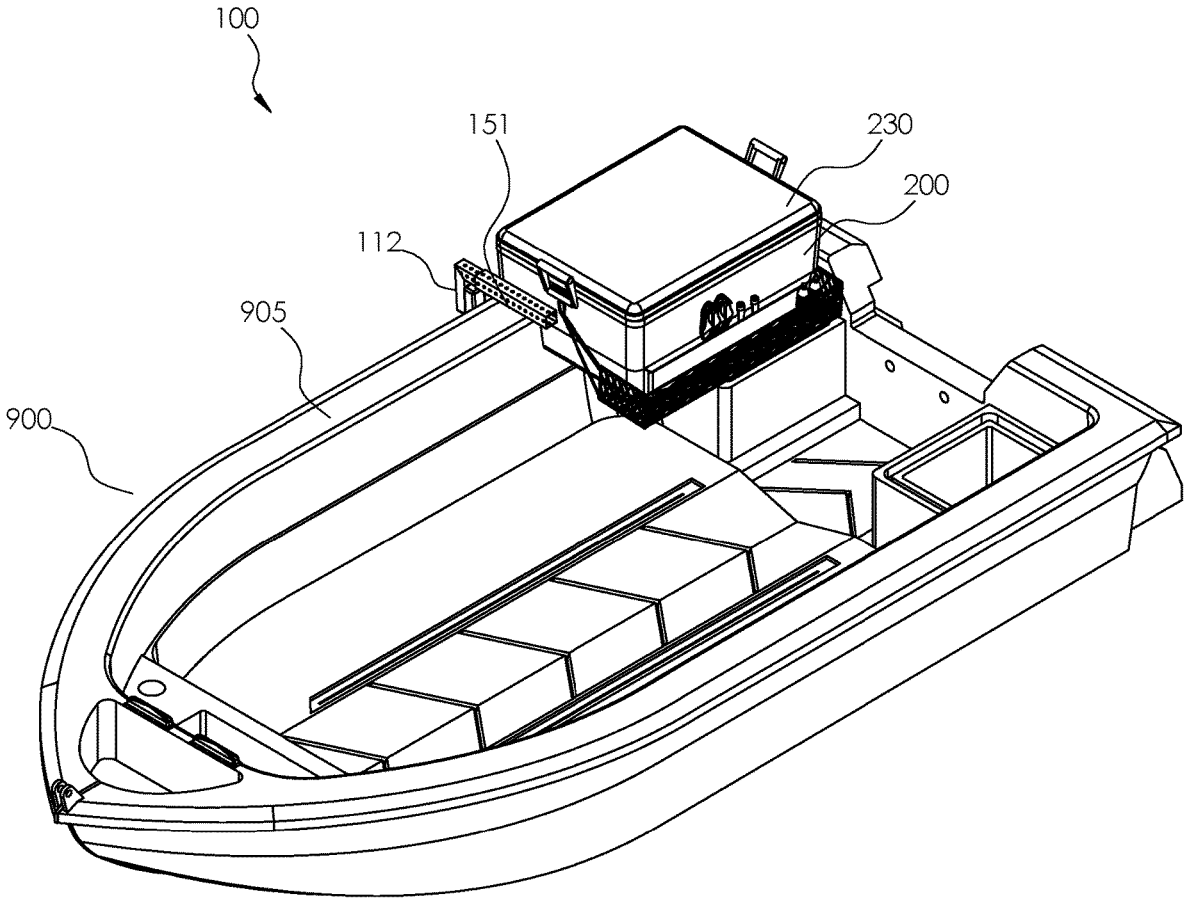
FIG. 7 is an in-use view of an embodiment of the disclosure.
Figure 8:
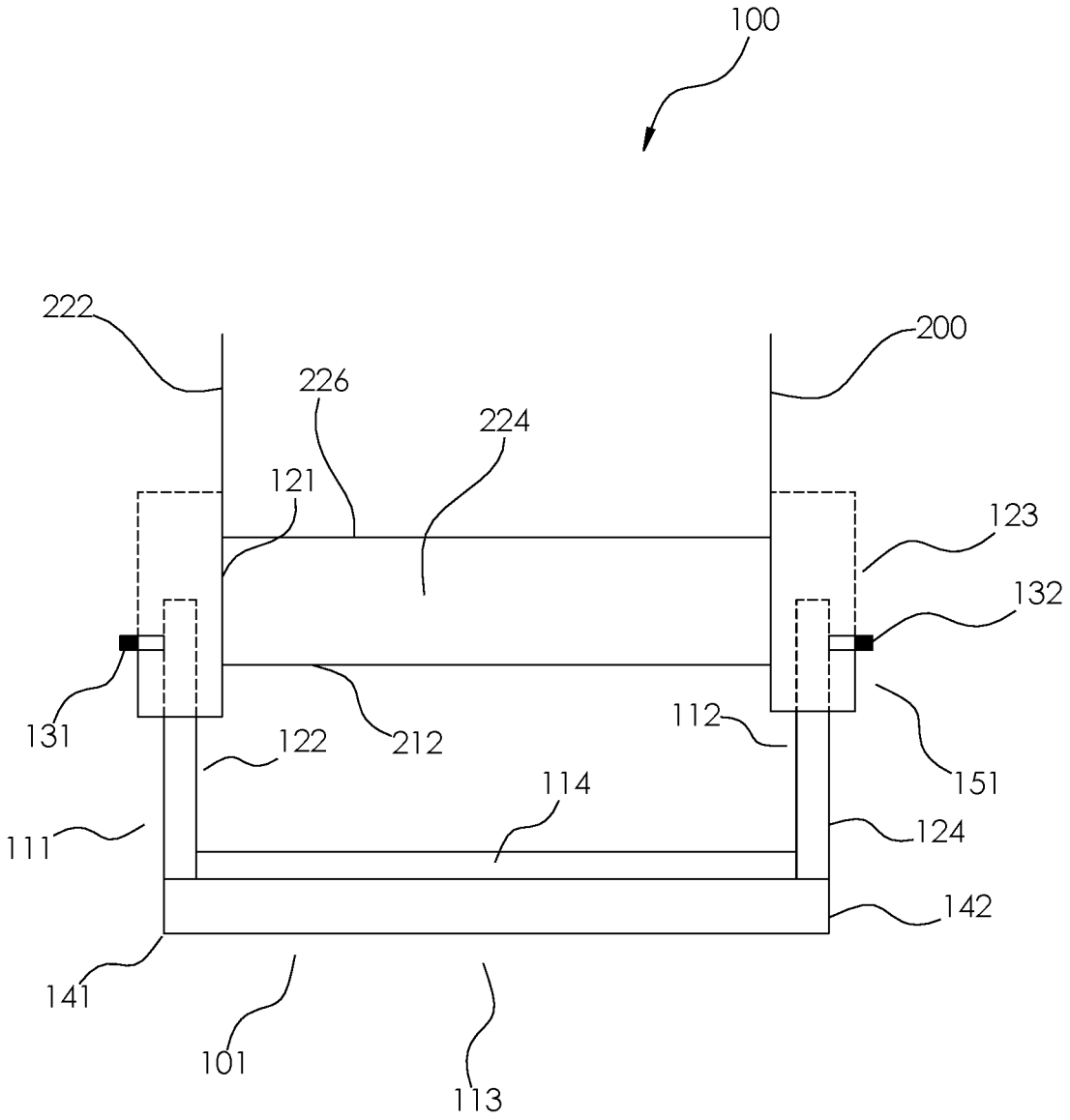
FIG. 8 is a detail bottom view of an embodiment of the disclosure.

Detailed reference will now be made to one or more potential embodiments of the disclosure, which are illustrated in FIGS. 1 through 8.

This non-provisional application is a continuation-in-part application filed under 37 CFR 1.53(b) that claims the benefit of United States 35 USC 120 from non-provisional application U.S. 16/174,357 filed on Oct. 30, 2018, by the inventor: Danny Street. This non-provisional application incorporates non-provisional application U.S. Ser. No. 16/174,357 in its entirety.

The present disclosure will only reference the elements of the non-provisional application U.S. Ser. No. 16/174,357 that are relevant to the innovations disclosed within this application. This is done for purposes of simplicity and clarity of exposition. The applicant notes that this disclosure incorporates non-provisional application U.S. Ser. No. 16/174,357 in its entirety into this application. The fact that any specific innovation selected from the one or more innovations disclosed within U.S. Ser. No. 16/174,357 is not addressed in this application should not be interpreted as an indication of defect in the above-referenced patent.

Within this disclosure, the non-provisional application U.S. Ser. No. 16/174,357 will also be referred to as the prior disclosure.

The sidewall-suspended boat cooler 100 (hereinafter invention) replaces the U-shaped space of the prior disclosure with a telescopic hook 101. Specifically, the rear wall 212 overhang extension of the prior disclosure is removed and replaced by the telescopic hook 101. The telescopic hook 101 catches on the sidewall 905 of the vessel 900 such that the telescopic hook 101 combines with both: a) the superior horizontal surface 224 of the prior disclosure; and, b) the vertical transfer surface 226 of the prior disclosure to form a mechanical U-shaped structure 151 in which the sidewall 905 of the vessel 900 inserts. The form factor of the telescopic hook 101 is adjustable such that the mechanical U-shaped structure 151 adjusts to accommodate variations in the form factor of the sidewall 905 of the vessel 900.

The telescopic hook 101 forms a mechanical U-shaped structure 151. The telescopic hook 101 attaches to the container 200. The telescopic hook 101 forms a hook structure that attaches the container 200 to the sidewall 905 of the vessel 900. The telescopic hook 101 suspends the container 200 from the sidewall 905 of the vessel 900. The telescopic hook 101 is a telescopic structure. The span of the length of the telescopic hook 101 adjusts in a direction parallel to a perpendicular line drawn through the planes of the front wall 210 and the rear wall 212 of the container 200. The telescopic hook 101 forms a structure that projects away from both a left side surface 777, a right side surface 778, and the rear wall 212 of the container 200. The span of the length of the telescopic hook 101 adjusts to the horizontal depth of the sidewall 905 of the vessel 900. The telescopic hook 101 comprises a first telescopic beam 111, a second telescopic beam 112, a crossbeam 113, and an elastomeric pad 114.

The first telescopic beam 111 is a telescopic structure that comprises a first arm 121, a second arm 122, and a first detent 131. The first detent 131 is a mechanical device that locks and secures the first arm 121 to the second arm 122. The first arm 121 is a hollow prism that is further defined with an inner dimension. The second arm 122 is a hollow prism that is further defined with an outer dimension. The second arm 122 is geometrically similar to the first arm 121. The span of the outer dimension of the second arm 122 is lesser than the span of the inner dimension of the first arm 121 such that the second arm 122 inserts into the first arm 121 in a telescopic fashion to form a composite prism structure. The span of the length of the first telescopic beam 111 adjusts by adjusting the relative position of the second arm 122 within the first arm 121.

The position of the second arm 122 relative to the first arm 121 is held in position using the first detent 131. The first detent 131 is selected from the group consisting of a cotter pin, a G snap collar, a cam lock collar, a threaded clutch, a split collar lock, and a spring-loaded ball lock.

The end of the first telescopic beam 111 that is distal from the container 200 attaches to the first end 141 to the crossbeam 113. The span of the distance between the first telescopic beam 111 between the container 200 and the crossbeam 113 adjusts by adjusting the span of the length of the first telescopic beam 111.

The end of the second arm 122 that is distal from the first arm 121 attaches to the first end 141 of the crossbeam 113. The end of the second arm 122 that is proximal to the first arm 121 inserts into the first arm 121. The end of the second arm 122 that is distal from the second arm 122 is rigidly affixed to the container 200 at the left side surface 777 of the container 200. The end of the first arm 121 that is proximal to the second arm 122 receives the second arm 122.

The second telescopic beam 112 is a telescopic structure that comprises a third arm 123, a fourth arm 124, and a second detent 132. The second detent 132 is a mechanical device that locks and secures the fourth arm 124 to the third arm 123. The third arm 123 is a hollow prism that is further defined with an inner dimension. The fourth arm 124 is a hollow prism that is further defined with an outer dimension. The fourth arm 124 is geometrically similar to the third arm 123. The span of the outer dimension of the third arm 123 is lesser than the span of the inner dimension of the fourth arm 124 such that the fourth arm 124 inserts into the third arm 123 in a telescopic fashion to form a composite prism structure. The span of the length of the second telescopic beam 112 adjusts by adjusting the relative position of the third arm 123 within the fourth arm 124.

The position of the third arm 123 relative to the fourth arm 124 is held in position using the second detent 132. The second detent 132 is selected from the group consisting of a cotter pin, a G snap collar, a cam lock collar, a threaded clutch, a split collar lock, and a spring-loaded ball lock.

The end of the second telescopic beam 112 that is distal from the container 200 attaches to the second end 142 to the crossbeam 113. The span of the distance between the second telescopic beam 112 between the container 200 and the crossbeam 113 adjusts by adjusting the span of the length of the second telescopic beam 112.

The end of the fourth arm 124 that is distal from the third arm 123 attaches to the second end 142 of the crossbeam 113. The end of the fourth arm 124 that is proximal to the third arm 123 inserts into the third arm 123. The end of the fourth arm 124 that is distal from the fourth arm 124 attaches to the container 200 at the left side surface 778 of the container 200. The end of the third arm 123 that is proximal to the fourth arm 124 receives the fourth arm 124.

The crossbeam 113 is a prism-shaped structure. The crossbeam 113 has a disk-shaped structure. The crossbeam 113 attaches to the first telescopic beam 111 such that congruent ends of the disk structure of the crossbeam 113 are perpendicular to the center axis of the first telescopic beam 111. The crossbeam 113 attaches to the second telescopic beam 112 such that congruent ends of the disk structure of the crossbeam 113 are perpendicular to the center axis of the second telescopic beam 112. The crossbeam 113 projects away from the first telescopic beam 111 and the second telescopic beam 112 in the inferior direction such that the crossbeam 113 is placed in contact with the sidewall 905 of the vessel 900. The crossbeam 113 further comprises a first end 141 and a second end 142. The first end 141 is formed in a lateral face of the crossbeam 113. The second end 142 is formed in a lateral face of the crossbeam 113.

The elastomeric pad 114 is an elastomeric structure. The elastomeric pad 114 is geometrically similar to a face of the disk-shaped structure of the crossbeam 113. The elastomeric pad 114 attaches to the face of the disk-shaped structure of the crossbeam 113 that is proximal to the sidewall 905 of the vessel 900. The elastomeric pad 114 forms a protective structure that prevents damage to the sidewall 905 by the vessel 900.

The mechanical U-shaped structure 151 forms the hook structure of the telescopic hook 101. The mechanical U-shaped structure 151 is bounded by the crossbeam 113, the first telescopic beam 111, the second telescopic beam 112, the superior horizontal surface 224 and the vertical transfer surface 226. The position of the crossbeam 113 is adjusted such that the sidewall 905 will insert between the crossbeam 113 and the vertical transfer surface 226. The elastomeric pad 114 is positioned proximal to the sidewall 905.

The following definitions were used in this disclosure:

Brink: As used in this disclosure, a brink refers to the edge or line formed by the intersection of a first plane or surface and a second plane or surface wherein a cant exists between the first plane or surface and the second plane or surface.

C-Channel: As used in this disclosure, the C-channel is a structure that is formed in a U-shape. The C-channel forms a prism shape with a hollow interior and an open face that forms a shape characteristic of the letter C. The open space of the C-channel is often used as a track.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned.

When the center axes of two cylinder, prism or pyramidal structures do not share the same line they are said to be offset.

Channel: As used in this disclosure, a channel is a tubular passage through which an object or fluid is passed through.

Closed Position: As used in this disclosure, a closed position refers to a movable barrier structure that is in an orientation that prevents passage through a port or an aperture. The closed position is often referred to as an object being "closed."

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Elastic: As used in this disclosure, an elastic is a material or object that deforms when a force is applied to it and that is able to return to its relaxed shape after the force is removed. A material that exhibits these qualities is also referred to as an elastomeric material. A material that does not exhibit these qualities is referred to as inelastic or an inelastic material.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Exterior: As used in this disclosure, the exterior is used as a relational term that implies that an object is not contained within the boundary of a structure or a space.

Foodstuff: As used in this disclosure, a foodstuff refers to an edible material that is used as food or a beverage.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1. Always use Correspond and One to One Gunwale: As used in this disclosure, a gunwale refers to a vertical exterior surface of a vessel that is above the waterline. The term gunwale is often used more specifically to refer to the port and starboard sides of the vessel.

Hinge: As used in this disclosure, a hinge is a device that permits the turning, rotating, or pivoting of a first object relative to a second object. A hinge designed to be fixed into a set position after rotation is called a locking hinge.

Hook: As used in this disclosure, a hook is an object that is curved or bent at an angle such that items can be hung on or caught by the object.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity when an object is positioned or used normally.

Instantiation: As used in this disclosure, an instantiation refers to a specific physical object or process that is created using a specification.

Insulating Structure: As used in this disclosure, an insulating structure is a structure that inhibits, and ideally prevents, the transfer of heat through the insulating structure. Insulating structures may also be used to inhibit or prevent the transfer of sound through the insulating structure. Methods to form insulating structures include, but are not limited to: 1) the use of materials with low thermal conductivity; and, 2) the use of a structural design that places a vacuum within the insulating structure within the anticipated transfer path of the heat or sound.

Interior: As used in this disclosure, the interior is used as a relational term that implies that an object is contained within the boundary of a structure or a space.

Ledge: As used in this disclosure, a ledge is a horizontal surface that projects away from a vertical surface. A ledge that projects away from, or overhangs, the vertical surface in the manner of a cantilever is referred to as an undercut ledge.

Lid: As used in this disclosure, a lid is a removable cover that is placed over an opening of a hollow structure to enclose the hollow structure.

Negative Space: As used in this disclosure, negative space is a method of defining an object through the use of open or empty space as the definition of the object itself, or, through the use of open or empty space to describe the boundaries of an object.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Open Position: As used in this disclosure, an open position refers to a movable barrier structure that is in an orientation that allows passage through a port or an aperture. The open position is often referred to as an object being "open."

Orientation: As used in this disclosure, orientation refers to the positioning of a first object relative to: 1) a second object; or, 2) a fixed position, location, or direction.

Pad: As used in this disclosure, a pad is a mass of soft material used as a filling or for protection against damage or injury. Commonly used padding materials include, but are not limited to, polyurethane foam, silicone, a polyester fill often referred to as fiberfill or polystyrene beads often referred to as stuffing beans or as bean bag chair beans.

Pan: As used in this disclosure, a pan is a hollow and prism-shaped containment structure. The pan has a single open face. The open face of the pan is often, but not always, the superior face of the pan. The open face is a surface selected from the group consisting of: a) an end of the prism structure that forms the pan; and, b) a lateral face of the prism structure that forms the pan. A semi-enclosed pan refers to a pan wherein an end of prism structure of the pan and a portion of the lateral face of the pan is also open.

Parapet: As used in this disclosure, a parapet is a vertical surface that is formed along the perimeter of a raised horizontal surface. The parapet projects away from the horizontal surface in the superior direction.

Primary Shape: As used in this disclosure, the primary shape refers to a description of the overall geometric shape of an object that is assembled from multiple components.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Relaxed Shape: As used in this disclosure, a structure is considered to be in its relaxed state when no shear, strain, or torsional forces are being applied to the structure.

Superior: As used in this disclosure, the term superior refers to a directional reference that is parallel to and in the opposite direction of the force of gravity when an object is positioned or used normally.

Suspend: As used in this disclosure, to suspend an object means to support an object such that the inferior end of the object does not form a significant portion of the load path of the object. Include inferior superior and load path.

Telescopic: As used in this disclosure, telescopic is an adjective that describes an object made of sections that fit or slide into each other such that the object can be made longer or shorter by adjusting the relative positions of the sections.

Transom: As used in this disclosure, a transom refers to a vertical exterior surface of a vessel that is above the waterline. The term transom is often used more specifically to refer to the stern of the vessel.

U-Shaped Structure: As used in this disclosure, a U-shaped structure refers to a three-sided structure comprising a crossbeam, a first arm, and a second arm. In a U-shaped structure, the first arm and the second arm project away from the crossbeam: 1) in the same direction; 2) at a roughly perpendicular angle to the crossbeam, and, 3) the span of the length of the first arm roughly equals the span of the length of the second arm.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Vessel: As used in this disclosure, a vessel is a type of vehicle. A vessel transports passengers, goods, or equipment over water.

With respect to the above description, it is to be realized that the optimum dimensional relationship for the various components of the invention described above and in FIGS. 1 through 8 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An accessory for a sidewall-suspended boat cooler comprising a telescopic hook; wherein the accessory for a sidewall-suspended boat cooler is configured for use with a sidewall-suspended boat cooler; wherein the sidewall-suspended boat cooler further comprises a U-shaped space; wherein the sidewall-suspended boat cooler further comprises a front wall, a rear wall, an inferior horizontal surface, a superior horizontal surface, and a vertical transfer surface; wherein the accessory for a sidewall-suspended boat cooler replaces the U-shaped space with the telescopic hook; wherein the telescopic hook comprises a first telescopic beam, a second telescopic beam, a crossbeam, and an elastomeric pad; wherein the crossbeam attaches the first telescopic beam to the second telescopic beam; wherein the first telescopic beam is affixed to a left side surface of the container; wherein the second telescopic beam is affixed to a right side surface of the container; wherein the sidewall-suspended boat cooler is configured for use with a vessel; wherein the vessel is further defined with a sidewall; wherein the telescopic hook catches on the sidewall of the vessel such that the telescopic hook combines with both the superior horizontal surface, and the vertical transfer surface to form a mechanical U-shaped structure in which the sidewall of the vessel inserts; wherein the form factor of the telescopic hook is adjustable such that the mechanical U-shaped structure adjusts to accommodate variations in the form factor of the sidewall of the vessel; wherein the telescopic hook forms the mechanical U-shaped structure; wherein the telescopic hook attaches to the container; wherein the telescopic hook forms a hook structure that attaches the container to the sidewall of the vessel; wherein the telescopic hook suspends the container from the sidewall of the vessel; wherein the telescopic hook is a telescopic structure; wherein the span of the length of the telescopic hook adjusts in a direction parallel to a perpendicular line drawn through the planes of the front wall and the rear wall of the container; wherein the telescopic hook forms a structure that projects away from the rear wall of the container; wherein the span of the length of the telescopic hook adjusts to the horizontal depth of the sidewall of the vessel.

2. The accessory for a sidewall-suspended boat cooler according to claim 1 wherein the first telescopic beam is a telescopic structure;

wherein the second telescopic beam is a telescopic structure.

3. The accessory for a sidewall-suspended boat cooler according to claim 2 wherein the crossbeam is a prism-shaped structure;

wherein the crossbeam has a disk-shaped structure;

wherein the crossbeam attaches to the first telescopic beam such that congruent ends of the disk structure of the crossbeam are perpendicular to the center axis of the first telescopic beam;

wherein the crossbeam attaches to the second telescopic beam such that congruent ends of the disk structure of the crossbeam are perpendicular to the center axis of the second telescopic beam.

4. The accessory for a sidewall-suspended boat cooler according to claim 3 wherein the crossbeam projects away from the first telescopic beam and the second telescopic beam in the inferior direction such that the crossbeam is placed in contact with the sidewall of the vessel.

5. The accessory for a sidewall-suspended boat cooler according to claim 4 wherein the crossbeam further comprises a first end and a second end;

wherein the first end is formed in a lateral face of the crossbeam;

wherein the second end is formed in a lateral face of the crossbeam.

6. The accessory for a sidewall-suspended boat cooler according to claim 5 wherein the first telescopic beam comprises a first arm, a second arm, and a first detent;

wherein the first detent is a mechanical device that locks and secures the first arm to the second arm;

wherein the second telescopic beam comprises a third arm, a fourth arm, and a second detent;

wherein the second detent is a mechanical device that locks and secures the fourth arm to the third arm.

7. The accessory for a sidewall-suspended boat cooler according to claim 6 wherein the first arm is a hollow prism that is further defined with an inner dimension;

wherein the second arm is a prism that is further defined with an outer dimension;

wherein the second arm is geometrically similar to the first arm;

wherein the third arm is a hollow prism that is further defined with an inner dimension;

wherein the fourth arm is a prism that is further defined with an outer dimension;

wherein the fourth arm is geometrically similar to the third arm.

8. The accessory for a sidewall-suspended boat cooler according to claim 7 wherein the span of the outer dimension of the second arm is lesser than the span of the inner dimension of the first arm such that the second arm inserts into the first arm in a telescopic fashion to form a composite prism structure;

wherein the span of the outer dimension of the third arm is lesser than the span of the inner dimension of the fourth arm such that the fourth arm inserts into the third arm in a telescopic fashion to form a composite prism structure.

9. The accessory for a sidewall-suspended boat cooler according to claim 8 wherein the span of the length of the first telescopic beam adjusts by adjusting the relative position of the second arm within the first arm;

wherein the span of the length of the second telescopic beam adjusts by adjusting the relative position of the third arm within the fourth arm.

10. The accessory for a sidewall-suspended boat cooler according to claim 9 wherein the position of the second arm relative to the first arm is held in position using the first detent;

wherein the position of the third arm relative to the fourth arm is held in position using the second detent.

11. The accessory for a sidewall-suspended boat cooler according to claim 10 wherein the end of the second arm that is distal from the first arm attaches to the second end of the crossbeam;

wherein the end of the second arm that is proximal to the first arm inserts into the first arm;

wherein the end of the second arm that is distal from the second arm attaches to the container at the left side surface of the container;

wherein the end of the first arm that is proximal to the second arm receives the second arm;

wherein the end of the fourth arm that is distal from the third arm attaches to the second end of the crossbeam;

wherein the end of the fourth arm that is proximal to the third arm inserts into the third arm;

wherein the end of the fourth arm that is distal from the fourth arm attaches to the container at the right side surface of the container;

wherein the end of the third arm that is proximal to the fourth arm receives the fourth arm.

12. The accessory for a sidewall-suspended boat cooler according to claim 11 wherein the elastomeric pad is an elastomeric structure;

wherein the elastomeric pad is geometrically similar to a face of the disk-shaped structure of the crossbeam;

wherein the elastomeric pad attaches to the face of the disk-shaped structure of the crossbeam that is proximal to the sidewall of the vessel;

wherein the elastomeric pad forms a protective structure.

13. The accessory for a sidewall-suspended boat cooler according to claim 12 wherein the mechanical U-shaped structure forms the hook structure of the telescopic hook;

wherein the mechanical U-shaped structure is bounded by the crossbeam, the first telescopic beam, the second telescopic beam, the superior horizontal surface, and the vertical transfer surface.

14. The accessory for a sidewall-suspended boat cooler according to claim 12 wherein the position of the crossbeam is adjusted such that the sidewall will insert between the crossbeam and the vertical transfer surface;

wherein the elastomeric pad is positioned proximal to the sidewall.

* * * * *